US011364647B2

(12) United States Patent
Eijkelkamp et al.

(10) Patent No.: US 11,364,647 B2
(45) Date of Patent: Jun. 21, 2022

(54) HAIR CUTTING DEVICE

(71) Applicant: KONINKLIJKE PHILIPS N.V., Eindhoven (NL)

(72) Inventors: Marcus Franciscus Eijkelkamp, Peize (NL); Arjen De Boer, Drachten (NL); Martijn Frans Johan Nab, Drachten (NL); Willem Maat, Rohel (NL); Roel Alexander Rethmeier, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/042,262

(22) PCT Filed: Apr. 8, 2019

(86) PCT No.: PCT/EP2019/058747

§ 371 (c)(1),
(2) Date: Sep. 28, 2020

(87) PCT Pub. No.: WO2019/197303

PCT Pub. Date: Oct. 17, 2019

(65) Prior Publication Data

US 2021/0046662 A1 Feb. 18, 2021

(30) Foreign Application Priority Data

Apr. 11, 2018 (EP) ..... 18166756

(51) Int. Cl.
*B26B 19/06* (2006.01)
*B26B 19/20* (2006.01)
(Continued)

(52) U.S. Cl.
CPC ..... *B26B 19/205* (2013.01); *B26B 19/046* (2013.01); *B26B 19/06* (2013.01); *B26B 19/102* (2013.01); *B26B 19/3886* (2013.01)

(58) Field of Classification Search
CPC ... B26B 19/102; B26B 19/107; B26B 19/205; B26B 19/3886; B26B 19/046; B26B 19/06
(Continued)

(56) References Cited

U.S. PATENT DOCUMENTS 1,745,997 A * 2/1930 Kocourek et al. .... B26B 19/205 30/201
1,774,046 A * 8/1930 Wahl ..... B26B 19/205 30/201
(Continued)

FOREIGN PATENT DOCUMENTS

CN 206105916 4/2017
DE 1 090 544 B * 10/1960 ..... B26B 19/205
(Continued)

OTHER PUBLICATIONS

International Search Report and Written Opinion dated Jul. 9, 2019 for International Application No. PCT/EP2019/058747 Filed Apr. 8, 2019.
(Continued)

*Primary Examiner* — Clark F Dexter

(57) ABSTRACT

A hair cutting device having a cutting unit, the cutting unit including a blade carrier carrying a cutting blade that has cutting teeth; a guard blade that has guard teeth. The blade is movable along the blade carrier relative to the cutting blade within a guard length range between a first guard position corresponding to a shortest hair cutting length of the cutting unit and a second guard position corresponding to the longest hair cutting length of the cutting unit. The blade carrier includes a stop configured to prevent movement of the guard blade past the first guard position and outside of the guard length range, thereby preventing the cutting length from being below the shortest cutting length.

15 Claims, 5 Drawing Sheets

(51) Int. Cl.
*B26B 19/10* (2006.01)
*B26B 19/38* (2006.01)
*B26B 19/04* (2006.01)

(58) Field of Classification Search
USPC ..... 30/43.91, 43.92, 201
See application file for complete search history.

(56) References Cited

U.S. PATENT DOCUMENTS 2,182,597 A * 12/1939 Oster ..... B26B 19/06 30/210
2,292,364 A * 8/1942 Cromonic ..... B26B 19/205 30/201
2,429,750 A 10/1947 Emard
2,445,530 A 7/1948 Majer
2,726,447 A * 12/1955 Maloy ..... B26B 19/205 30/202
3,093,901 A * 6/1963 Wahl ..... B26B 19/205 30/201
3,280,456 A * 10/1966 Erickson et al. ..... B26B 19/44 30/133
3,295,201 A * 1/1967 Pucino ..... B26B 19/20 30/200
3,430,342 A 3/1969 Wahl
3,531,862 A 10/1970 Bender et al.
5,325,589 A * 7/1994 Kubo ..... B26B 19/205 30/195
5,551,153 A 9/1996 Simms
6,568,083 B1 5/2003 Taniguchi et al.
6,742,262 B2 * 6/2004 Rizzuto, Jr. et al. ..... B26B 19/205 30/201
8,341,846 B1 1/2013 Holmes
2008/0282550 A1 11/2008 Piwaron
2012/0272532 A1 * 11/2012 Sobagaki et al. ..... B26B 19/205 30/201
2017/0341245 A1 11/2017 Nayna et al.
2019/0152076 A1 5/2019 Sablatschan

FOREIGN PATENT DOCUMENTS

DE 2 161 809 A1 * 5/1973 ..... B26B 19/205
DE 38 00 966 A1 * 7/1989 ..... B26B 19/205
EP 3059052 8/2016
JP H0539471 5/1993

OTHER PUBLICATIONS

International Preliminary Report on Patentability dated Jan. 22, 2020 for International Application No. PCT/EP2019/058747 Filed Apr. 8, 2019.

* cited by examiner

HAIR CUTTING DEVICE

CROSS REFERENCE TO RELATED APPLICATIONS

This application is the U.S. National Phase application under 35 U.S.C. § 371 of International Application No. PCT/EP2019/058747 filed Apr. 8, 2019, which claims the benefit of European Patent Application Number 18166756.9 filed Apr. 11, 2018. These applications are hereby incorporated by reference herein.

FIELD OF THE INVENTION

The disclosure relates to a hair cutting device.

BACKGROUND OF THE INVENTION

Hair cutting devices typically comprise a toothed cutting blade disposed against a toothed or slotted guard. In use, the guard is arranged to contact a user's skin and the cutting blade is reciprocally movable about the guard to cut any hair that becomes trapped between the cutting blade and the guard. The distance that the guard spaces the cutting blade from the user's skin sets the length of cut of the hair and in some cutting units the guard may be movable relative to the cutting blade to vary the length of cut of the cutting device.

It is to be noted that US patent document U.S. Pat. No. 2,429,750 A discusses a hair clipper having a moveable blade and a stationary blade which are to reciprocate with respect to each other while keeping all other relative orientations constant. The hair clipper according to this document is further disclosed to have a movable guard comb. This guard comb is operated via a manual knob and comprises a compression spring forcing the comb outwardly.

It is further to be noted that US patent application document U.S. 2008/282550 A1 discloses a blade assembly for a hair clipper having an upper and a lower blade which are to reciprocate with respect to each other to cut hairs. The two blades may further be adjusted with respect to each other to change the cutting length (remaining hair length) setting of the hair clipper.

SUMMARY OF THE INVENTION

According to a first aspect of the disclosure there is provided a hair cutting device comprising a cutting unit, the cutting unit comprising a blade carrier carrying a cutting blade, the cutting blade comprising cutting teeth, a guard blade comprising guard teeth, wherein the guard blade is movable along the blade carrier relative to the cutting blade within a guard length range between a first guard position corresponding to a shortest hair cutting length of the cutting unit and a second guard position corresponding to the longest hair cutting length of the cutting unit, and wherein the blade carrier comprises a stop configured to prevent movement of the guard blade past the first guard position and outside of the guard length range, thereby preventing the cutting length from being below the shortest cutting length.

Accordingly, the hair cutting device provides a mechanism for preventing the user varying the cutting distance, or cut length, such that the cutting blade becomes too close to a user's skin to cause irritation or injury. The hair cutting device therefore allows a minimum distance between the cutting blade and the guard blade to be defined along the length of the cutting unit in order to prevent skin damage.

In use, the cutting unit may be subject to forces, for example forces that a user may place upon the guard blade during use, that could cause the guard blade to retract to a position where the cutting length approaches zero and the cutting blade is exposed to the user's skin "unguarded". Such an endstop, provided as above, reduces the likelihood of this occurring during day to day use of the cutting device.

The endstop also reduces the cutting length from becoming undesirably small due to any movement of other components. For example another component (such as a component forming part of an adjustment train for moving the guard blade) may not move beyond a certain tolerance, but such movement could nevertheless undesirably force the guard blade to a position where the cutting length is shorter than the predetermined shortest cutting length. Such movement may be reduced or eliminated by the presence of the stop.

The hair cutting device further comprise a guard biasing element for biasing the guard blade to the first guard position. This increases the robustness of the cutting device since the biasing element may reduce the play in the adjustment mechanism and reduce or eliminate relative movement between the cutting blade and the guard blade.

The guard biasing element may be for biasing the guard blade into abutment with the stop of the blade carrier. This ensures that the cutting device is biased into the position of its shortest cutting length. Whilst the guard biasing element may bias the guard into its shortest cutting position, the stop may prevent the hair cutting length from becoming too short so as to cause the cutting blade to come into contact with a user's skin such that it could damage their skin. The guard biasing element may be a spring, for example a torsion spring.

The stop may be provided for preventing the cutting length from becoming too small not only due to forces applied by a user but also due the force on the guard applied by the guard biasing element. The stop may therefore prevent the guard biasing element from causing the guard blade to move beyond the first guard position. The combination of these features hence serves to better fix the limit position of the guard blade. The stop may allow a play between the adjusting mechanism of the device and the guard blade which will ensure that the guard blade rests against the endstop.

The stop may be disposed symmetrically within the blade carrier. For example, the stop may be disposed in the centre of the blade carrier.

The stop may be a first stop and the device may further comprises a second stop. The second stop may be located in the blade carrier. The first and second stops may be spaced apart and may be disposed symmetrically within the blade carrier. Two stops may further reduce the play in the system. Two stops may further prevent relative movement between the cutting blade and the guard blade by fixing them in a relative configuration. The first and second stops may be disposed symmetrically within the blade carrier. For example, the stops may be disposed within the blade carrier each at the same distance from the exterior of the blade carrier. Two stops may allow the adjustment mechanism to bias the guard blade away from one of the stops thereby preventing the cut length from being undesirably small.

A symmetrical configuration may also aid in ensuring proper alignment of the two blades to enhance the predictability and uniformity of the length of haircut. The stop may be disposed in a central position, i.e. so that the middle or centre of the guard blade abuts the stop. Two stops may be disposed relatively close to each other such that the middle or centre of the guard blade abuts both stops. In one example arrangement, two stops may be disposed such that a distal end of an edge of the guard blade abuts one stop and a central portion of the guard blade abuts the other stops. In a further example arrangement, two stops may be disposed such that two distal ends of an edge of the guard blade abut each respective stop.

Having two endstops disposed away from the centre of the guard blade may decrease the likelihood of the cut length becoming undesirably small.

In a further example arrangement, the stop may be a first stop and the device may further comprise at least two further stops. Any number of stops may be provided in other example arrangements.

The hair cutting device may further comprise an actuator for moving the guard, the actuator may be movable between a first actuator position corresponding to the shortest cutting length, and a second actuator position corresponding to the longest cutting length of the cutting unit.

The cutting blade may be biased into a cutting position by a cutting biasing element. This will assist in reducing relative movement between the cutting blade and the guard blade. The cutting biasing element may comprise at least one spring in the blade carrier.

BRIEF DESCRIPTION OF THE DRAWINGS

Embodiments of the invention will now be described, by way of example, by reference to the accompanying drawings, in which.

DETAILED DESCRIPTION OF THE EMBODIMENTS

Figure 1:
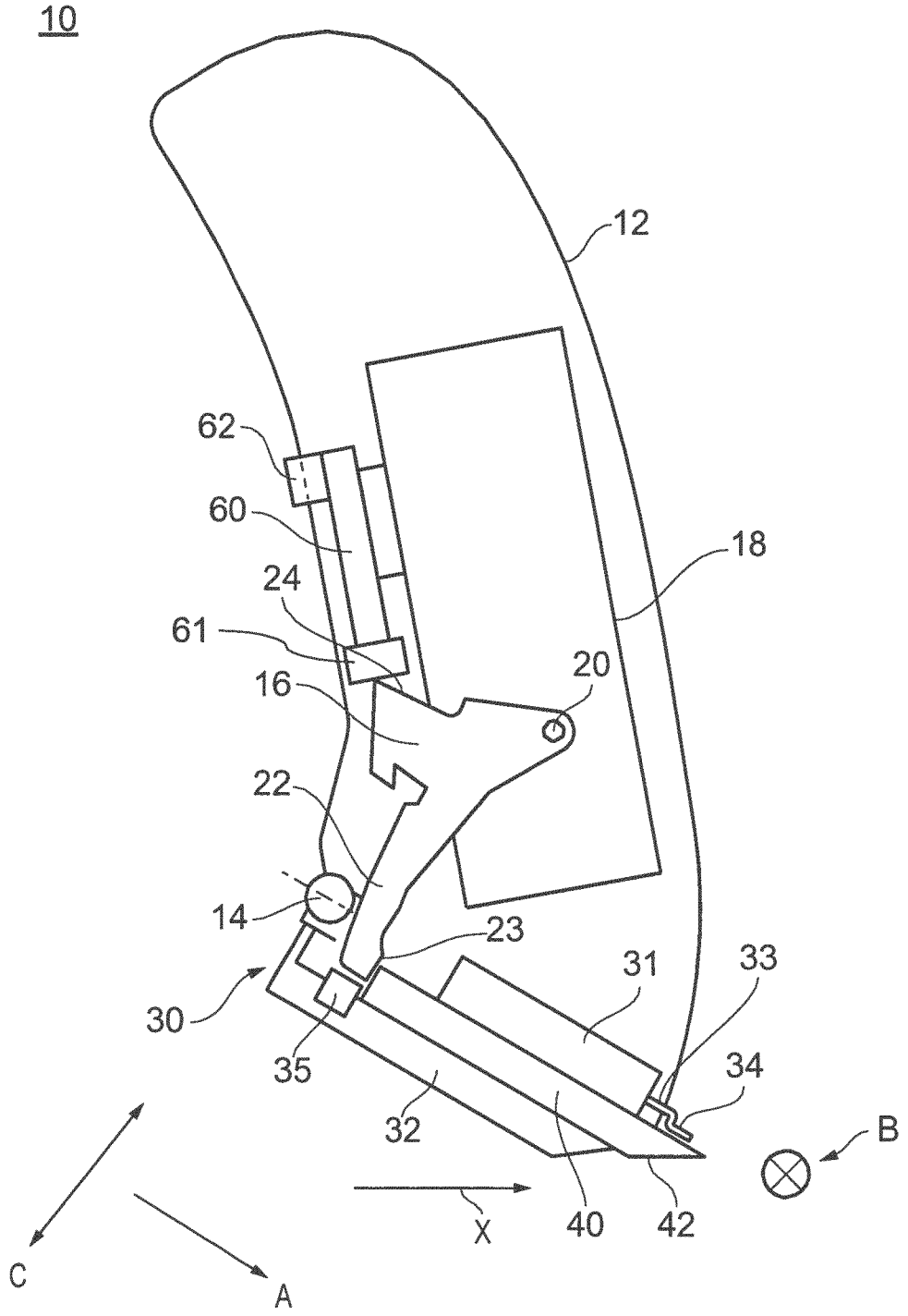
FIG. 1 schematically shows a cross-sectional view of a hair cutting device corresponding to a shortest cut length.

FIG. 1 shows a hair cutting device 10 comprising a cutting unit 30. The cutting unit 30 comprises a blade carrier 32 and the blade carrier comprises a cutting blade assembly 31 housing a cutting blade 33. The cutting blade 33 comprises cutting teeth 34. The cutting unit 30 comprises a guard blade 40 housing guard teeth 42.

The hair cutting device 10 comprises a handle 12 housing a drive unit 18 for driving the cutting unit 30. The drive unit 18 may comprise a motor and a blade drive unit which extends from the motor to engage the cutting unit 30 such that operation of the motor causes reciprocating motion of the cutting blade 33 in the direction of axis B (perpendicular to both axes A and C) and therefore causes reciprocating motion of the cutting teeth 34 relative to the guard blade. Hair trapped between the guard blade teeth 42 and the reciprocating cutting teeth 34 will therefore be cut by the reciprocating cutting teeth 34.

Figure 2A:
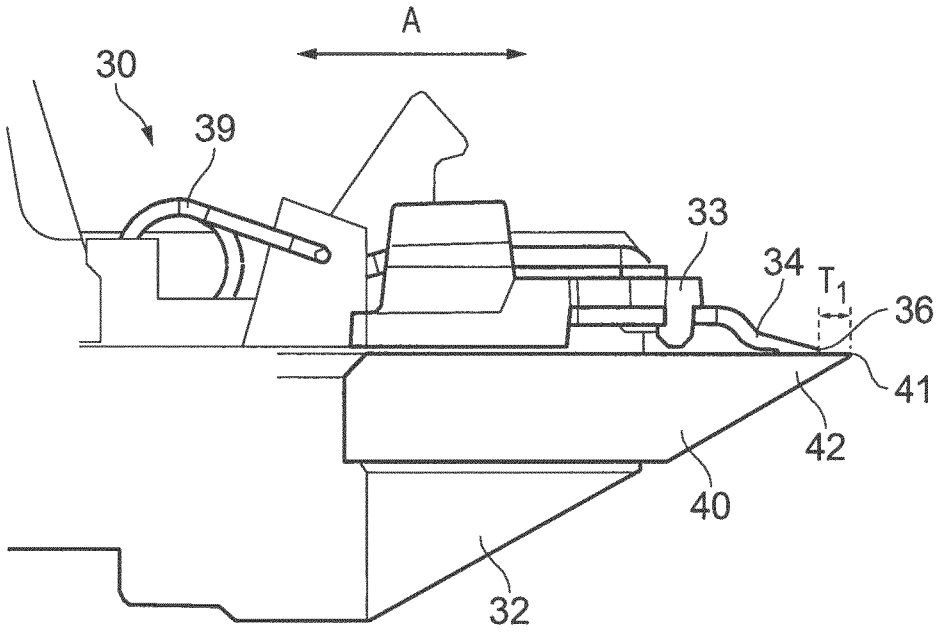
FIGS. 2A and 2B schematically show cross-sectional side views of the cutting unit of FIG. 1.
Figure 2B:
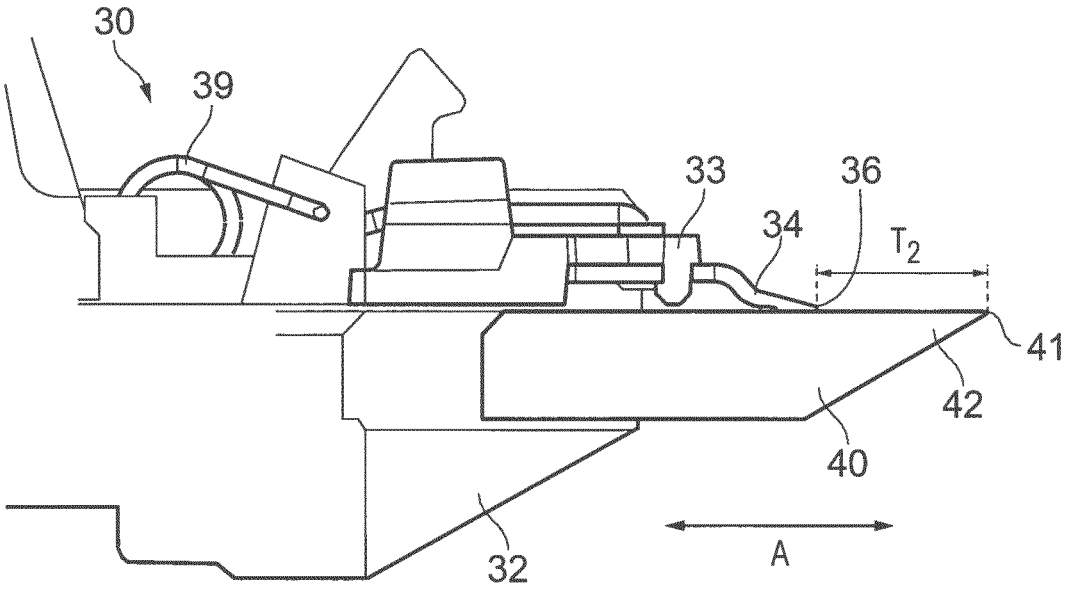

Referring to FIGS. 2A and 2B, the guard blade 40 is movable along the blade carrier 32 relative to the cutting blade 33 within a guard length range. The guard blade 402 is movable in the direction of arrow A. The guard blade 40 is movable within a guard length range from a first guard position to a second guard position. The first guard position corresponds to a shortest cut length and the second guard position corresponds to a longest cut length. The first guard position is shown in FIG. 2A in which the guard teeth 42 are proximate the cutting teeth 34. The second guard position is shown in FIG. 2B in which a free ends of the guard teeth 42 are remote from the cutting teeth 34.

Each cutting tooth 34 comprises a cutting tip 36 and each guard tooth 42 comprises a guard tip 41. It will be appreciated that the distance between the tips 36, 41 along the blade carrier 32 is variable as the position of the guard blade 40 is adjusted. The distance between the tips of the cutting teeth and the guard teeth when the guard blade 40 is in its first position corresponding to a shortest cut length is T1 and is shown in FIG. 2A. The distance between the tips of the cutting teeth and the guard teeth when the guard blade 40 is in its second position corresponding to a longest cut length is T2 and is shown in FIG. 2A.

It will therefore be appreciated that the guard blade 40 is movable along the blade carrier relative to the cutting blade 33 to adjust the distance between the tips 36 of the cutting teeth and the tips of the guard teeth. This distance may be referred to as the "tip-to-tip" length. It will thus also be appreciated that the tip-to-tip length determines the length of cut of the hair. A shorter tip-to-tip length (for example as depicted in FIG. 2A where the tips 41 of guard blade teeth 42 are adjacent to the tips 36 of cutting teeth 34) corresponds to a longer length of hair that is cut, leaving a shorter length of hair on the skin of a user. Similarly, a longer tip-to-tip length (for example as depicted in FIG. 2B where the tips of the guard blade teeth 42 are remote from the tips of the cutting teeth 34) corresponds to a shorter length of cut hair that is cut, leaving a longer length of hair on the skin of a user.

Accordingly it will be appreciated that the guard teeth 42 of the guard blade 40 project beyond the cutting teeth 34 of the cutting blade 33. The tip-to-tip length may alternatively be defined as the distance by which the guide blade 40 projects beyond the cutting blade 33.

Referring again to FIG. 1 the handle 12 may also house an actuator 16 for moving the guard blade 40. In this example, the actuator 16 is rotatable relative to a housing forming the handle 12 from a first actuator position corresponding to the shortest cutting length (length of cut) of the cutting unit 30 and a second actuator position corresponding to the longest cutting length (length of cut) of the cutting unit 30. In this example, the actuator 16 is generally in the form of a lever rotatable about a pin 20, which is supported on the handle housing. The actuator comprises a first arm 22, which extends from the pin 20 to an actuation point 23 at the distal end of the actuator 16. The actuation point 23 is configured to engage the guard blade 40 to move the guard blade 40 as will be described below.

In the illustrated arrangement, the cutting unit 30 is pivotably coupled to the handle 12 about a pivot 14. In other arrangements, the cutting unit 30 may instead be attached in a fixed orientation relative to the handle, or may be detachable from the handle for servicing or replacement.

To cause the actuator 16 to move the guard blade 40 a control element 60 is slidably mounted in the housing of the handle 12 and is slidable between a first control position corresponding to the first actuator position and a second control position corresponding to the second actuator position. Movement of the control element from its first to its second control positions causes the actuator 16 to move from its first actuator position to its second actuator position. The control element 60 is provided with a head 61 which engages a second arm 24 of the actuator 16. A slide button 62 is connected to a side of the control element 60 and extends through the housing of the handle 12 allowing a user to actuate the control element 60 by pushing the slide button 62.

Figure 3:
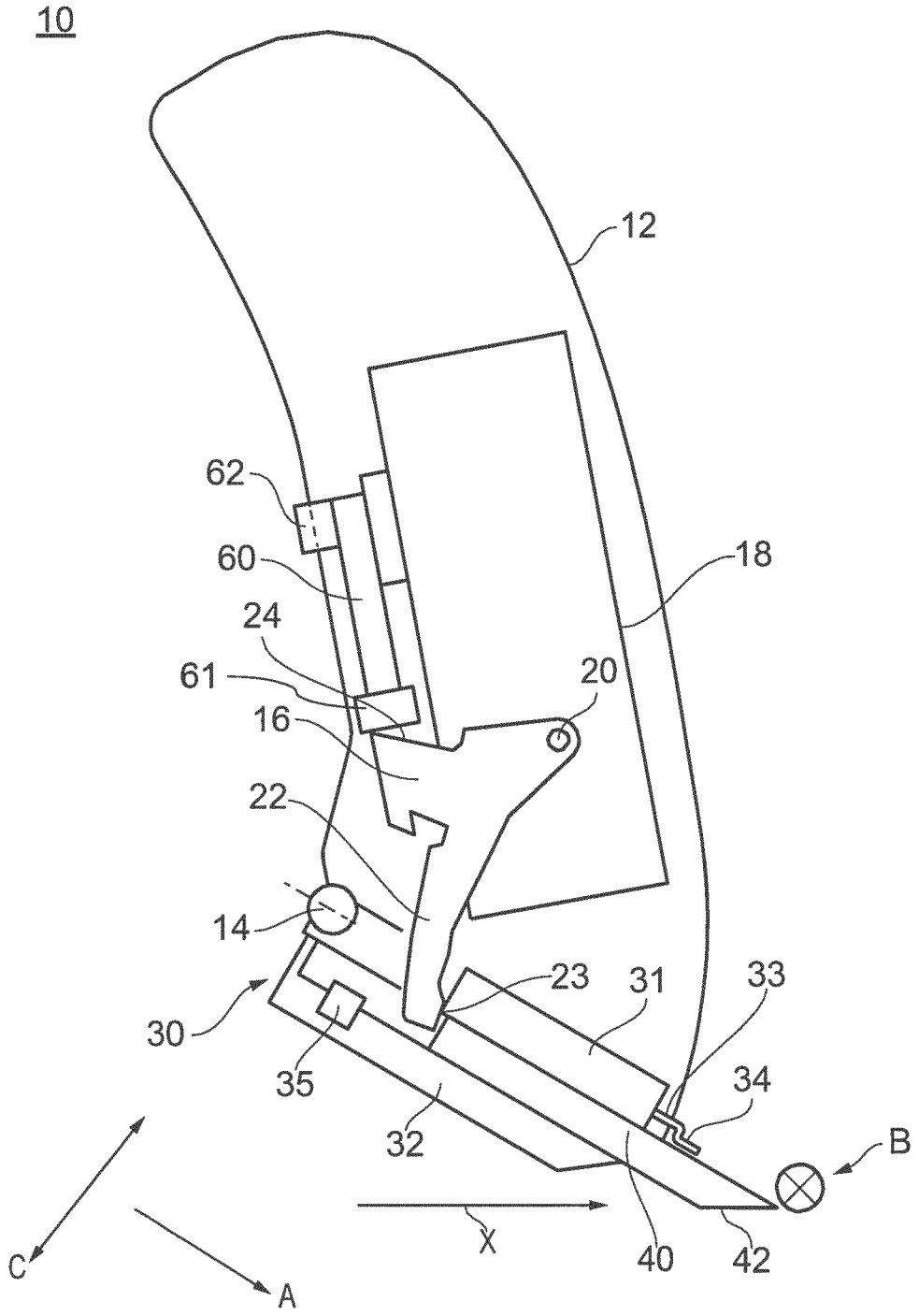
FIG. 3 schematically shows a cross-sectional view of the hair cutting device of FIG. 1 corresponding to a longest cut length.

In FIG. 1 the guard 40, actuator 16, and control element 60 are in their first positions. To move the guard 40 towards its second position a user manipulates the slide button 62 to cause the control element 60 to move towards its second control position. This will cause the head 61 of the control element to engage the second arm 24 of the actuator 16 causing the actuator 16 to pivot about the pin pivot 20 towards its second actuator position. The pivoting movement of the actuator 16 will cause the actuation point 23 to push the guard blade 40 towards its second position. This configuration is shown in FIG. 3 in which the control element 60 has been moved into its second control position, causing the head 61 to have displaced to its maximum extent, thereby pivoting the actuator 16 about pivot 20 to its second actuator position. In the second actuator position the actuation point 23 is moved to its maximum extent in which the guard blade 40 has been moved to its second guard position corresponding to the longest cut length.

Figure 4:
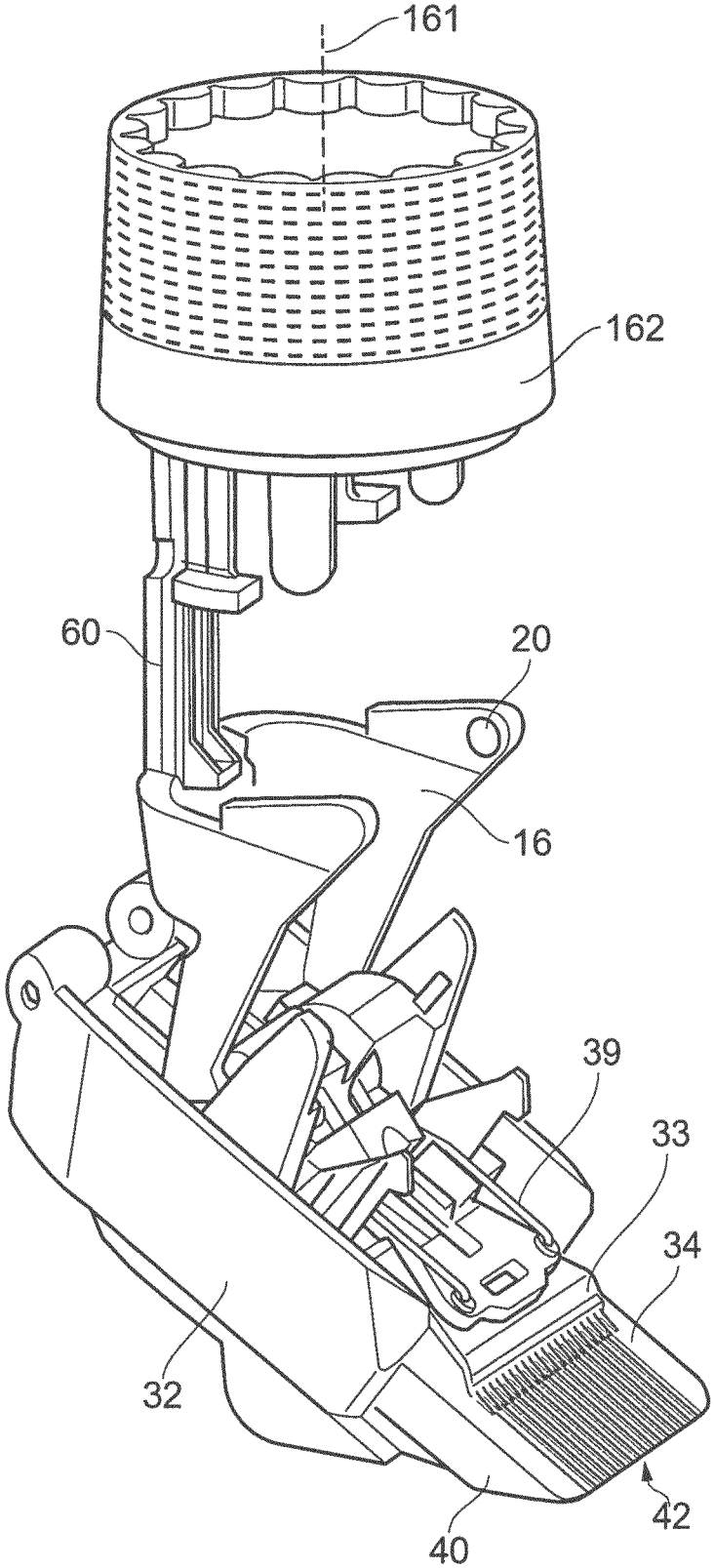
FIG. 4 schematically shows a perspective view of an example actuation mechanism for a hair cutting device.

FIG. 4 shows an alternative example of the actuation mechanism to move the guard blade 40. In this example rather than a slide button 62 the control element 60 is connected to a user-rotatable dial 162. The dial 162 is rotatable about rotation axis 161 between a first dial position and a second dial position. Rotation of the dial 162 causes a corresponding linear movement in the control element 60 such that the first dial position and the second dial position correspond to the first and second control positions, respectively, and movement from the first dial position to the second dial position causes the control element 60 to move from its first control position to its second control position, thereby causing the guard blade 40 to move from its first guard position to its second guard position in the manner described above.

A cutting biasing element (not visible in FIG. 1 but visible in FIGS. 4, 2A and 2B) in the form of a spring 39 is configured to bias the cutting blade in its cutting position. Spring 39 may be attached to, or provided on either the blade carrier 32 or any other part of the cutting unit 30.

Referring again to FIG. 1 the blade carrier 32 comprises a stop 35. Stop 35 is configured to prevent movement of the guard blade 40 past the first guard position and outside of the guard length range. Stop 35 is therefore configured to prevent the cutting length from being below the shortest cutting length. Stop 35 is configured to engage the guard blade 40 and may be fixed to or supported on the blade carrier 32 such that stop 35 can withstand a force attempting to move the guard blade 40 past its first guard position and outside of the guard length range, for example the manual force of a user attempting to shorten the tip-to-tip length by pushing the tips of the guard teeth 42 toward the tips of the cutting teeth 34.

Figure 5A:
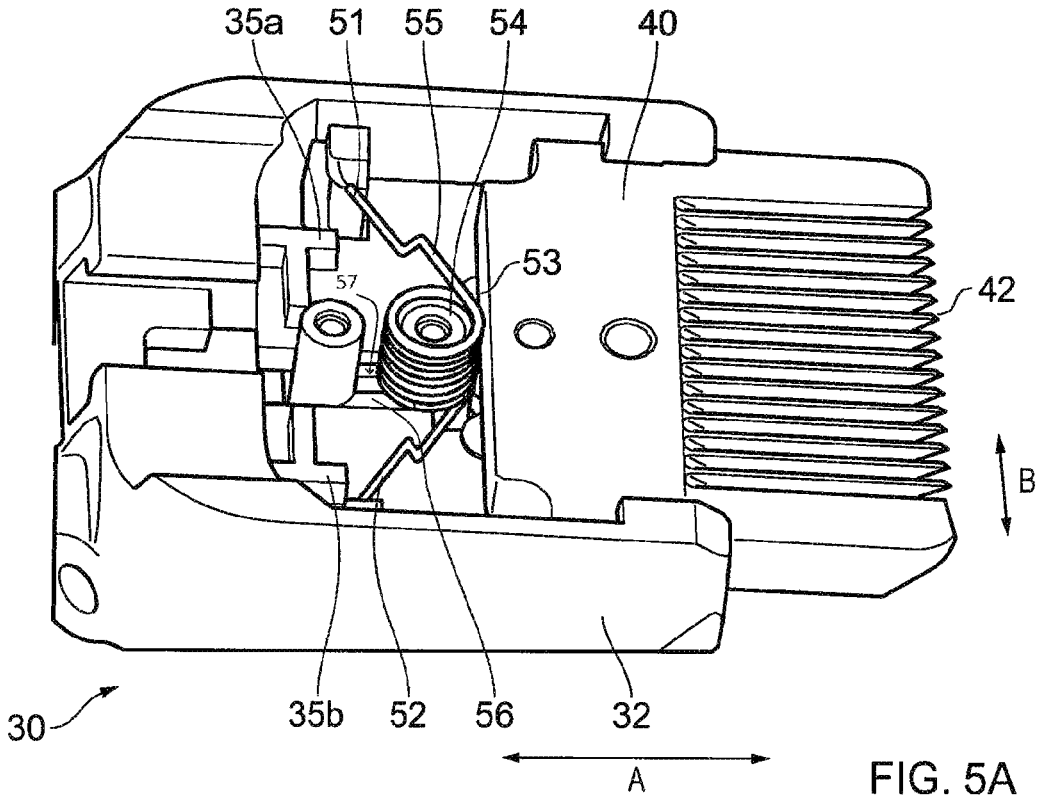
FIGS. 5A and 5B schematically show perspective views of the cutting unit of FIG. 1.
Figure 5B:
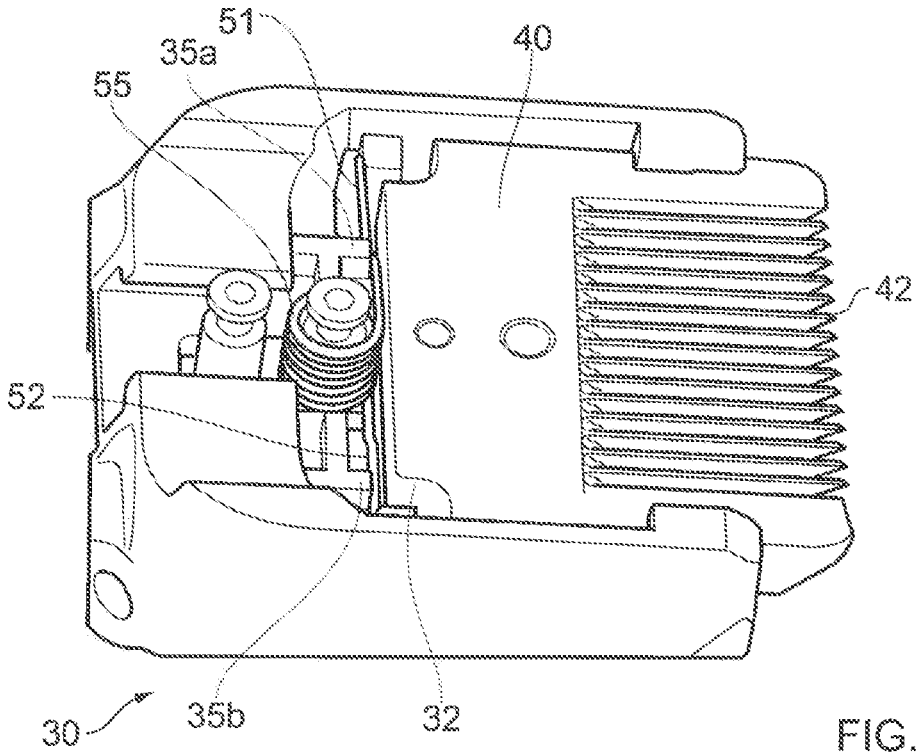

FIGS. 5A and 5B show one example of a cutting unit 30 in further detail. FIG. 5A shows the guard blade 40 in its second guard position corresponding to a longest cut length and FIG. 5B shows the guard blade 40 in its first guard position corresponding to a shortest cut length.

Cutting unit 30 comprises first and second stops, 35*a*, 35*b* attached to the blade carrier 32. Any means or method of attaching the stops 35*a*,35*b* to the blade carrier 32 is within the scope of this disclosure. For example they may be moulded integrally with the blade carrier. The first and second stops 35*a*, 35*b* are spaced apart and disposed symmetrically within the blade carrier. As shown in FIG. 5B the stops are configured to prevent the guard blade 40 from moving out of the guard range and past the first guard position.

A guard biasing element depicted in the illustrated example as a torsion spring 55 is provided for biasing the guard blade 40 into the first guard position. As shown in FIG. 5B the spring 55 may bias the guard blade into abutment with the stops 35*a*, 35*b*. In FIG. 5B the guard blade 40 is shown resting against the stops 35*a*, 35*b*, being biased by the spring 55. It will be appreciated that in this position, the tip-to-tip length T1 is at its shortest, and this setting is solely dictated by the extent to which the guard blade teeth 42 extend beyond the cutting blade teeth 34, see FIG. 2A.

FIG. 5A shows one example of a biasing mechanism for the guard blade 40. The guard blade 40 is attached to a spring support 56 which is slideably mounted in a groove 57 formed in the blade carrier 32. The spring support 56 supports the spring 55 comprising coils 53 integrally formed with two arms 51 and 52 extending away from the coils 53 and resiliently biased by the coils 53 to a first configuration, shown in FIG. 5B.

The spring support 56 may in some examples be part of the guard blade 40 itself, for example it may be a single unitary component with the guard blade 40 or may be attached to the guard blade 40. A projection 54 is fixed to and extends from the spring support 56. The coils 53 of the spring are mounted on the projection 54. The spring 55 therefore engages the spring support and applies a biasing force through the projection into the guard blade 40. In other arrangements, the spring 55 may engage the guard blade 40 directly.

Each arm 51, 52 of the spring 55 engages a respective stop 35*a*, 35*b*. Due to the engagement between the coils 53 and the projection 54, movement of the guard blade 40 and the spring support attached thereto in the direction A, toward the second guard position shown in FIG. 5A, causes the spring arms 51, 52 to deflect and wind up the coils 53. In this way, upon release of a force that caused the guard blade 40 to move toward the second position, the coils 53 will unwind and the arms 51, 52 will rotate about the projection 54, biasing it and the guard blade 40 towards the first guard position shown in FIG. 5B.

Referring back to FIG. 1 but with reference to FIG. 5A, the spring 55 biases the actuator 16 to its first actuator position and biases the control element 60 to its first control position.

Accordingly, in one arrangement, when the guard blade 40 is moved from its first guard position to its second guard position (by movement of the control element 60 and actuator 16 as described above) this movement is opposed by the spring 55. When the force that caused the guard blade 40 to move towards its second position is released, the bias provided by spring 55 urges the guard blade 40 to return to its first position, as described above. This causes the actuator 16 to pivot towards the first actuator position which, in turn, causes the control element to slide back to its first control position.

The stops 35*a*, 35*b* prevent the guard blade 40 from moving past its first actuator position and thereby prevent the actuator 16 from pivoting past its first actuator position and out of the range defined between the first and second actuator positions. The stops 35*a*, 35*b* may also prevent the control element 60 from moving past its first control position and out of the movement range defined by the first and second control positions.

A user-overridable lock (not shown) may be provided to lock to the guard blade 40 in any position within its range of movement.

Although the guard biasing element is depicted as a spring, and in the illustrated arrangement as a torsion spring, it will be appreciated that any biasing means is within the scope of this disclosure.

While the invention has been illustrated and described in detail in the drawings and foregoing description, such illustration and description are to be considered illustrative or exemplary and not restrictive; the invention is not limited to the disclosed embodiments. Various alternative examples are discussed through the detailed description. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A hair cutting device comprising a cutting unit, the cutting unit comprising:

a blade carrier carrying a cutting blade, the cutting blade comprising cutting teeth;

a guard blade comprising guard teeth;

a torsion spring having a coil integrally formed with a first and a second arm extending away from the coil;

a spring support that supports said torsion spring;

wherein the cutting blade is arranged to reciprocate with respect to the guard blade such that during use of the device hair trapped between the guard blade teeth and the cutting teeth will be cut;

wherein the guard blade is movable along the blade carrier relative to the cutting blade within a guard length range between a first guard position corresponding to a predetermined shortest cutting length by the cutting unit and a second guard position corresponding to a predetermined longest cutting length by the cutting unit;

wherein the torsion spring is configured and arranged to bias the guard blade to the first guard position;

wherein the blade carrier comprises a stop configured to prevent movement of the guard blade past the first guard position and outside of the guard length range, thereby preventing a cutting length from being less than the shortest cutting length;

wherein the guard blade is attached to the spring support, the spring support being slidably mounted in a groove formed in the blade carrier.

2. The hair cutting device according to claim 1 wherein the torsion spring is configured to bias the guard blade into abutment with the stop of the blade carrier.

3. The hair cutting device according to claim 1, further comprising at least one additional stop.

4. The hair cutting device according to claim 3, wherein the stop and the at least one additional stop are disposed symmetrically within the blade carrier.

5. The hair cutting device according to claim 1, wherein the first and second arms engage the blade carrier and the coil engages the guard blade.

6. The hair cutting device according to claim 1, wherein the coil is mounted on a projection connected to the guard blade.

7. The hair cutting device according to claim 6, wherein the projection is fixed to the spring support connected to the guard blade.

8. The hair cutting device according to claim 1, further comprising an actuator operably connected to the guard blade, the actuator being movable between a first actuator position corresponding to the shortest cutting length, and a second actuator position corresponding to the longest cutting length of the cutting unit.

9. The hair cutting device according to claim 8, wherein the actuator is moveable between the first actuator position and the second actuator position by a control element mounted on a handle of the hair cutting device.

10. The hair cutting device according to claim 9, wherein the control element is provided with a manually actuatable slide button.

11. The hair cutting device according to claim 1, wherein the guard blade engages the stop directly in the first position.

12. The hair cutting device according to claim 1, wherein the torsion spring is mounted on a projection that extends from the spring support.

13. A hair cutting device comprising a cutting unit, the cutting unit comprising:

a blade carrier carrying a cutting blade, the cutting blade comprising cutting teeth;

a guard blade comprising guard teeth;

wherein the cutting blade is arranged to reciprocate with respect to the guard blade such that during use of the device hair trapped between the guard blade teeth and the cutting teeth will be cut;

wherein the guard blade is movable along the blade carrier relative to the cutting blade within a guard length range between a first guard position corresponding to a predetermined shortest cutting length by the cutting unit and a second guard position corresponding to a predetermined longest cutting length by the cutting unit;

wherein the blade carrier comprises a stop configured to prevent movement of the guard blade past the first guard position and outside of the guard length range, thereby preventing a cutting length from being less than a shortest cutting length;

wherein the device further comprises a guard biasing element for biasing the guard blade to the first guard position; and wherein the guard biasing element comprises a torsion spring having a coil integrally formed with a first and a second arm extending away from the coil, wherein the first and second arms engage the blade carrier and the coil engages the guard blade.

14. The hair cutting device according to claim 13, wherein the coil is mounted on a projection connected to the guard blade.

15. The hair cutting device according to claim 14, wherein the projection is fixed to a spring support connected to the guard blade.

* * * * *